US005651338A

United States Patent [19]

Pacheco et al.

[11] Patent Number: 5,651,338

[45] Date of Patent: Jul. 29, 1997

[54] ADJUSTABLE INDUCTION MANIFOLD SYSTEM

[76] Inventors: Allan A. Pacheco; Orlando D. Pacheco, both of 1650 Sixth St., Santa Fe, N. Mex. 87501

[21] Appl. No.: 624,719

[22] Filed: Mar. 26, 1996

[51] Int. Cl.[6] ..... F02M 35/10

[52] U.S. Cl. ..... 123/184.34; 123/184.55

[58] Field of Search ..... 123/184.24, 184.34, 123/184.32, 184.42, 184.47, 184.55

[56] References Cited

U.S. PATENT DOCUMENTS

| | | | |
|---|---|---|---|
| 1,335,990 | 4/1920 | Short . | |
| 1,336,704 | 4/1920 | Kirkham . | |
| 1,355,068 | 10/1920 | Vincent . | |
| 2,806,457 | 9/1957 | Moseley . | |
| 3,366,145 | 1/1968 | Lohn . | |
| 3,520,284 | 7/1970 | Ruoff et al. | 123/184.34 |
| 4,153,015 | 5/1979 | Hampton . | |
| 4,210,107 | 7/1980 | Shaffer | 123/184.34 |
| 4,415,507 | 11/1983 | Voliva . | |
| 4,418,676 | 12/1983 | Iwao . | |
| 4,711,225 | 12/1987 | Holderle et al. . | |
| 4,977,866 | 12/1990 | Wilkins | 123/184.34 |
| 5,022,355 | 6/1991 | Billingsly et al. . | |
| 5,494,011 | 2/1996 | Haller | 123/184.34 |

*Primary Examiner*—Marguerite McMahon
*Attorney, Agent, or Firm*—John Edward Roethel

[57] ABSTRACT

The adjustable induction manifold system of the present invention comprises a manifold plate that bolts to the engine in the same manner and place as the factory or after-market manifold being used. The open plenum is connected to the manifold plate by tube runners and hose clamps, and in certain applications with brackets as well. Two carburetor base plates are provided, one for four-barrel carburetors and one for two barrel carburetors. Each carburetor base plate has up to two block off plates to be used depending on the number of carburetors used. Each carburetor base plate attaches to the top of the plenum using eight bolts. Each tube runner is made from a high strength material that is impervious to gasoline, alcohol and methanol such as nitrile tubing. The tube runner also has an internally bonded helical coil so that the tubing is rigid and non-collapsible. Thermostat housing and water plates also attach to the manifold and radiator with rubber hoses and clamps for the purpose of cooling the engine.

5 Claims, 7 Drawing Sheets

ADJUSTABLE INDUCTION MANIFOLD SYSTEM

This invention relates to an adjustable induction manifold system, and more particularly to an adjustable induction manifold system that uses interchangeable tube runners that connect the plenum to the manifold so that the effective length of the fluid flow path can be varied to optimize the performance, torque or efficiency of the engine.

BACKGROUND OF THE INVENTION

For many years, automotive engineers, engine builders and mechanics have sought to increase the efficiency and performance of internal combustion engines. It is known that the length and shape of the runners that extend from the plenum (the area underneath the carburetor or fuel injection system) are very important to the overall efficiency and performance realized.

For example, in 1971, Edelbrock started one trend with its Tarantula manifold which used a small volume open chamber plenum manifold with small cross section runners. m Shortly thereafter, Weiand followed with its X-elerator manifold and in 1976 Holly introduced it Street Dominator line of manifolds. These manifolds have an open plenum design and the mixture velocity is quite high so that low and mid-range performance is close to that provided by the stock manifold, but at the same time considerably better power is provided at the top end or high RPM range. These manifolds create amazing power increases using only a four barrel carburetor.

The intake manifold is actually an extension of the intake ports on the carburetor and most of the fluid flow considerations that apply to head ports also apply to the manifold runners. It is important to view each manifold runner and head port as a separate leg of the dynamic flow system, and the path that the air/fuel mixture takes from the mouth of the manifold runner at the plenum to the combustion chamber should be, in a sense, considered as one.

Presently, virtually all performance manifolds are based on a large centrally located plenum with reasonably straight runners from the plenum to the port entries in the head. This configuration is commonly called an open plenum manifold. The biggest advantage of this configuration is that the common manifold under the carburetor allows each runner/cylinder to draw fuel from all four of the carburetor venturis (when using a four barrel carburetor) when the throttle is wide open. In effect, the partially vaporized air/fuel mixture exits the bottom of the carburetor venturis as four separate streams. As each cylinder draws on the plenum, the four streams (or portions of the streams) bend toward the appropriate runner entry and form a single stream, which then flows into the runner and feeds the cylinder. This allows each runner to draw a greater volume of the air/fuel mixture during the available induction period.

In a typical V-type engine arrangement using either a four barrel carburetor system or a two barrel center carburetor system, it is virtually impossible to make all of the runners in an open plenum manifold identical in length. The runners leading to the cylinders on the far comers of the engine will be longer and the runners leading to the cylinders at the center of the engine will be shorter. This means that the flow path to each of the cylinders will be different. For example, in a manifold layout typically used in the V-8 type engine, four cylinders will be fed with a long flow path and four cylinders will be fed with a short flow path. Thus, the biggest problem to overcome in an open plenum manifold design is finding ways to minimize these flow path differences.

Early open manifold designs were terrible in this regard. In some designs, the end cylinders ran very lean while the center cylinders ran very rich. Other designs that attempted to compensate for this problem ended up running the end cylinders rich and the center cylinders lean. The more recent designs from the engine manufacturers are much improved and work much better.

The most important aspect when using an open plenum manifold is to match up the open plenum manifold with the requirements of the particular engine being used. The engine will respond differently depending on the length, volume and contours of the manifold runners. A manifold with longer runners will produce better low RPM torque and power while a manifold with shorter runners will produce better top end torque and power.

One of the best ways to improve low and mid-range torque and power is to use a cross ram type manifold. This type of manifold uses two carburetors positioned in a transverse manner instead of in line with the engine. The carburetor positioned closest to the right bank of cylinders feeds the left bank of cylinders. The carburetor positioned closest to the left bank of cylinders feeds the right bank of cylinders. With this configuration, the runners can be made quite a bit longer with good results.

Notwithstanding the type of manifold being used, the mechanic who is trying to increase the performance, torque or efficiency of the engine is still faced with the problem that the runner lengths are fixed.

It is an object of the present invention to provide to provide the mechanic with the ability to vary the length of the runners so that the proper configuration can be selected to optimize the performance, torque or efficiency of whatever engine is being used.

It is a feature of the present invention that interchangeable runners are provided so that the mechanic can select the optimal runner length for each cylinder. The open plenum manifold has a compact design for quicker response from the engine. The base plates and block off plates on the top of the plenum offer the mechanic the option of using one, two or three two-barrel carburetors or one, two or three four-barrel carburetors or one, two or three fuel injection systems or more of either for special applications.

It is an advantage of the present invention that any V-type or I-type engine can be configured for the highest performance, torque or efficiency be simply selecting the number and type of carburetors or fuel injection systems and then selecting the proper runner lengths for each of the cylinders.

Other objects, features and advantages of the present invention will become apparent from a consideration of the following detailed description.

SUMMARY OF THE INVENTION

The adjustable induction manifold system of the present invention comprises a manifold plate that bolts to the engine in the same manner and place as the factory or after-market manifold being used. The open plenum is connected to the manifold plate by tube runners and hose clamps. Two carburetor base plates are provided, one for four-barrel carburetors and one for two barrel carburetors. Each carburetor base plate has up to two block off plates to be used depending on the number of carburetors used. Each carburetor base plate attaches to the top of the plenum using eight bolts. Each tube runner is made from a high strength material that is impervious to gasoline, alcohol and methanol such as nitrile tubing. The tube runner also has an internally bonded helical coil so that the tubing is rigid and non-collapsible. Thermostat housing and water plates also attach to the manifold and radiator with rubber hoses and clamps for the purpose of cooling the engine.

DETAILED DESCRIPTION OF THE PREFERRED EMBODIMENTS

Figure 1:
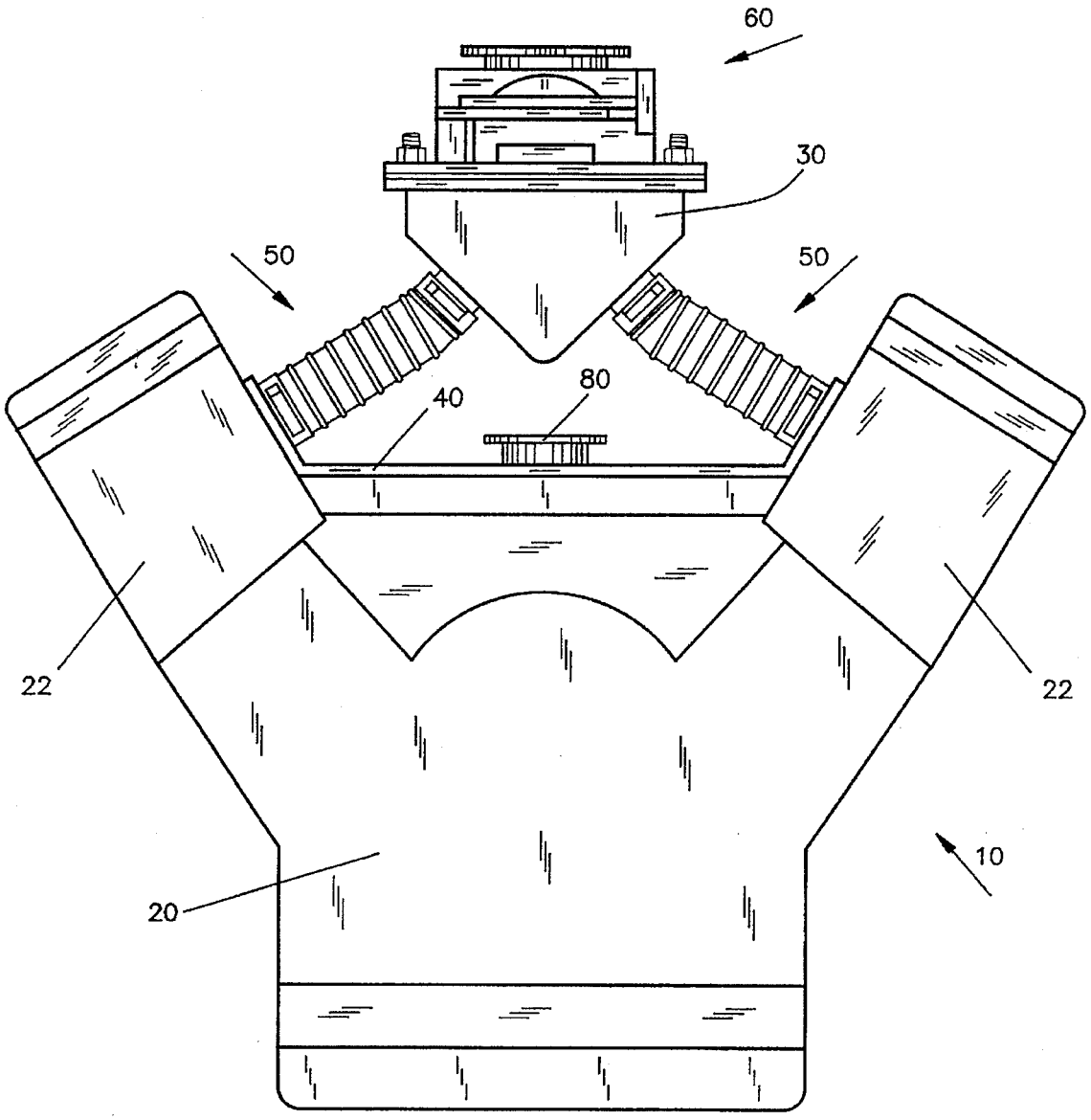
FIG. 1 shows an end view of the adjustable induction manifold assembly of the present invention.

An engine 10 having the adjustable induction manifold assembly of the present invention is shown generally in FIG. 1. The engine 10 represented is a typical V-8 engine although any suitable engine type can be configured to operate with the adjustable induction manifold assembly. As seen in the end view of the engine 10, the lower portion is the crankcase 20 and a left cylinder head 22 and a right cylinder head 22 are integrally associated with the crankcase 20. Between the two cylinder heads 22 there is provided a plenum 30 on top of which are mounted one or more carburetors 60, as desired. Alternatively, instead of carburetors, fuel injection systems can be used and whenever the term "carburetor" is used in this description, it is intended to include either a carburetor or a fuel injection system. Between the two cylinder heads 22, there is provided a manifold plate 40 with a thermostat housing 80 mounted thereon. Each combustion chamber in each cylinder in the cylinder block is connected by a tube runner 50 to an associated entry port on the plenum 30, as will be explained more fully hereinafter.

Figure 2:
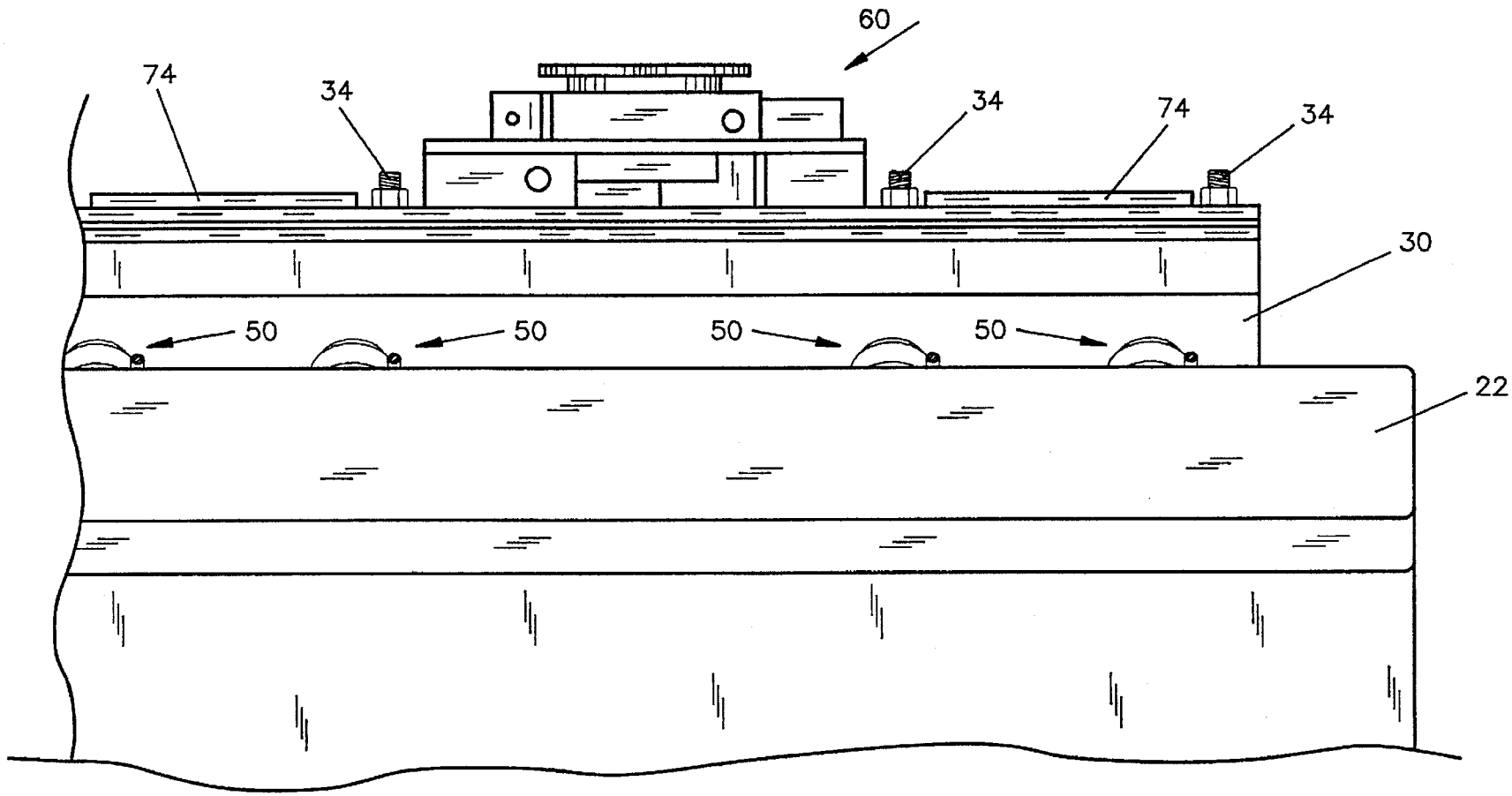
FIG. 2 shows a side view of the adjustable induction manifold assembly of the present invention.
Figure 3:
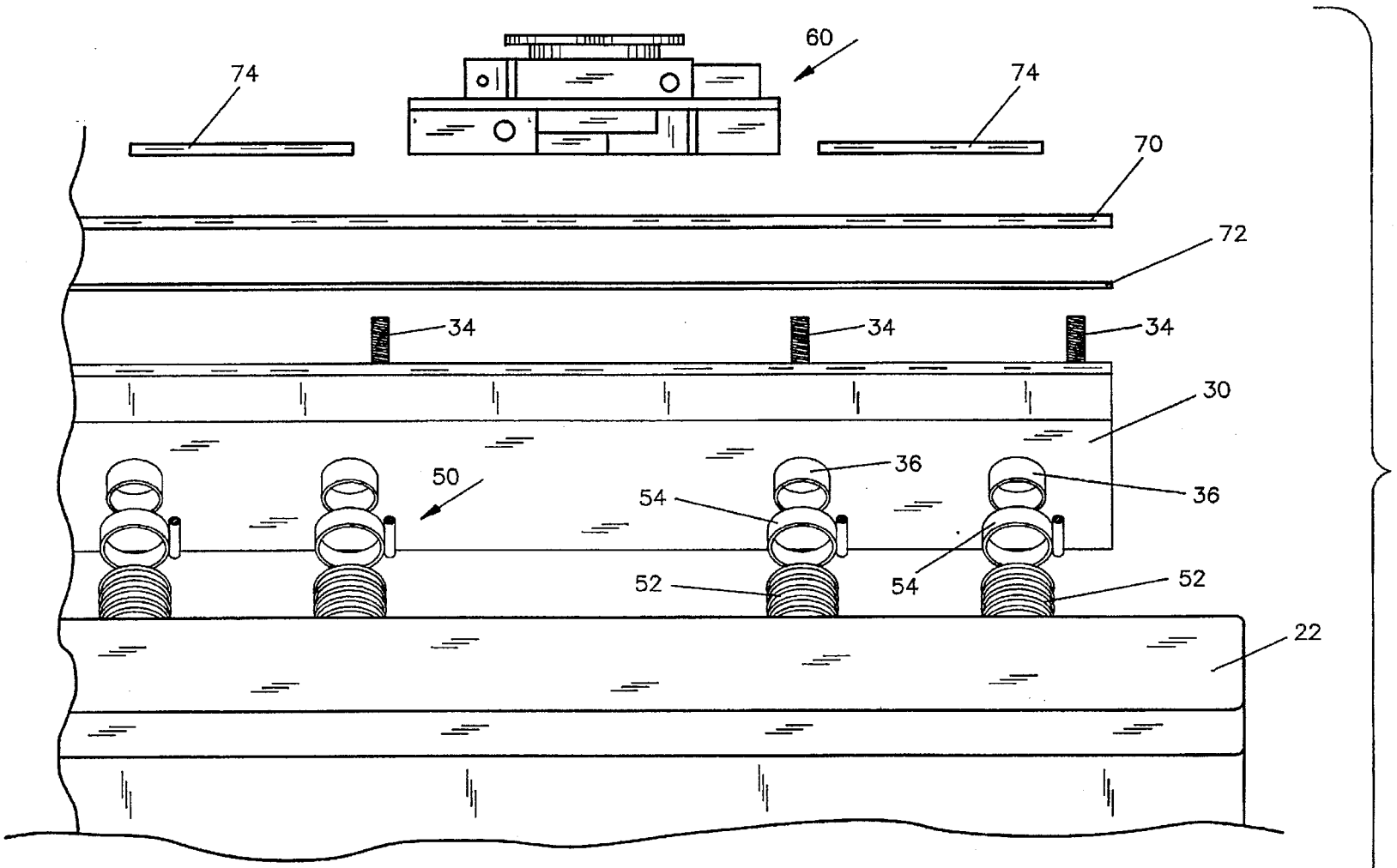
FIG. 3 shows an exploded side view of the adjustable induction manifold assembly of the present invention.

FIGS. 2 and 3 show a side view of the adjustable induction manifold of the present invention. FIG. 2 shows the invention in the fully assembled position, while FIG. 3 shows the invention as an exploded view so that the parts are more easily identified.

As used in the V-8 type engine as shown, the plenum 30 is generally V-shaped with a hollow interior with or without baffles for aiding in the proper distribution of gases the combustion chambers of the cylinders. The plenum 30 includes eight plenum ports 36 (four on each side), and each plenum port 36 is associated with one of the cylinders in the cylinder head 22. Each plenum port 36 is connected to its corresponding manifold port 42 on the manifold plate 40 mounted on the cylinder head 22 by means of a tube runner 52. The connection of one end of the tube runner 52 to the plenum port 36 is by way of a conventional hose clamp 54 and likewise the other end of the tube runner 52 is also securely connected to the corresponding manifold port 42 on the manifold plate 40 by way of another hose clamp 54.

On the top of the plenum 30 there is placed a base plate 70 with a gasket 72 set in between for sealing purposes. The base plate 70 doses off the top of the plenum 30 except for three openings which serve as the carburetor intake for any carburetor 60 mounted on the top of the plenum 30. If only one carburetor 60 is being used, then the unneeded carburetor intake openings are closed off by means of a block off plate 74, two of which are shown in FIG. 3. Of course, if two carburetors 60 are used, then only the block off plate 74 is needed and likewise, if the engine is to be operated using three carburetors 60, then none of the block off plates 74 would be necessary. A plurality of bolts 34 are spaced around the perimeter of the top of the plenum 30 and the gasket 72 and base plate 70 are also provided with corresponding apertures around their perimeters to allow the gasket 72 and the base plate 70 to be mounted over the bolts 34 and securely attached to the plenum 30.

Figure 4:
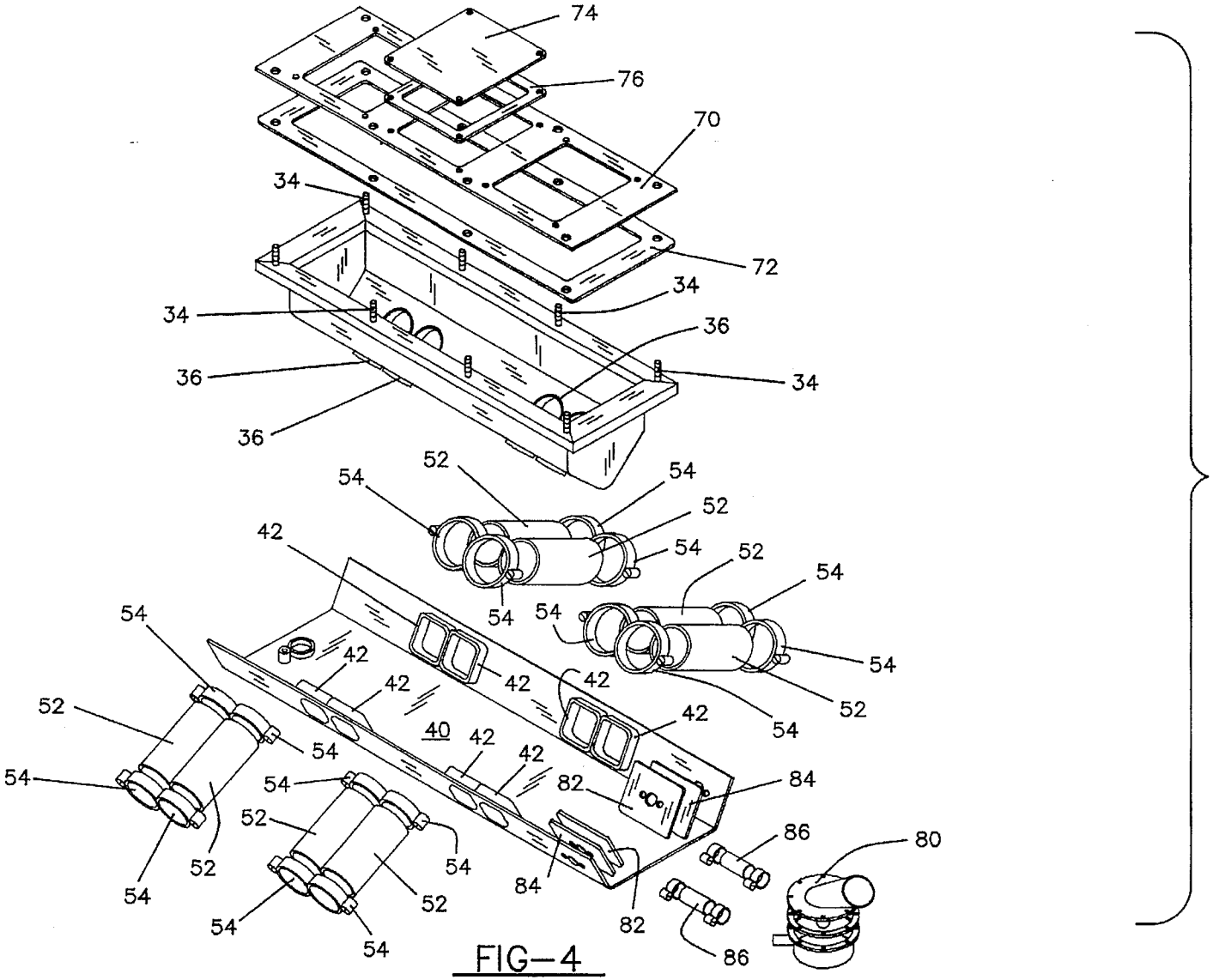
FIG. 4 shows an exploded perspective view of the adjustable induction manifold assembly of the present invention.

FIG. 4 is a fully exploded view of the adjustable induction manifold assembly of the present invention, only in perspective view so that more details of the adjustable induction manifold assembly can be shown. In this view, the carburetor 60 has been removed and the base plate 70 is shown as a generally rectangular piece sized to fit over the top of the plenum 30. The base plate 70 has a plurality of apertures around its perimeter, which apertures align with the bolts 34 on the upper surface of the plenum 30. The gasket 72, again with a plurality of like apertures around its periphery through which the bolt 34 can pass, is disposed between the base plate 70 and the top of the plenum 30 to provide sealing.

In this embodiment, the base plate 70 has three carburetor intake openings so that up to three carburetors can be mounted thereon. If less than three carburetors are to be used on the engine, then one or two block off plates 74 (only one of which is shown in FIG. 4) each with a suitable gasket 76 are provided to close off the top of the plenum 30.

As further shown in FIG. 4, the fact that the plenum 30 is V-shaped allows each side of the V to have four plenum ports 36, one to be associated with each cylinder on its respective cylinder head 22. Likewise, the manifold plate 40 has an upturned flange on each side thereof in which are provided four manifold ports 42, one to be associated with each cylinder on its respective cylinder head 22. Each plenum port 36 is connected to its corresponding manifold port 42 by means of the tube runner 50 through the use of two hose clamps 54 as described above.

Also mounted on the manifold plate 40 (but not necessarily an integral part of the manifold plate) is a thermostat housing 80. The thermostat housing 80 is connected by means of rubber hoses 86 and clamps to two water plates 82, one mounted on each flange of the manifold plate 40 and a gasket 84 is used to seal each water plate 82 on the flange. The thermostat housing 80 is also connected to a radiator (not shown) and, in combination with the two water plates 82, functions to provide coolant to the engine. In certain applications, brackets (not shown) are used in mounting the thermostat housing 80 to the engine.

In the preferred embodiment of the present invention, each tube runner 50 is made of a strong synthetic material that is highly resistant to gasoline, alcohol, methanol and other common engine fuels. In the most preferred embodiment, the tube runner 50 is made of Nitrile™ synthetic and is provided with an internally bonded helical metal coil so that the tube runner 50 is non-collapsible under normal conditions and will support the weight of the plenum 30.

In the configuration of the invention shown in FIG. 4, eight tube runners 50 are used to support the plenum 30, four on each side with two toward the front and two toward the back of the plenum 30. This is the preferred design for the plenum used on a V-8 engine. For other engine types, slight modifications are made to the plenum dimensions and configuration and the number of tube runners and plenum ports are increased or decreased to correspond to the number of cylinders being used.

For example, for a V-12 engine, four additional plenum ports (two on each side) are added to the bottom of the plenum; in a V-10 engine, two additional plenum ports (one on each side) are added to the bottom of the plenum. In a V-6 engine, two plenum ports (one on each side) are closed off. In an I-6 engine, two plenum ports are added to one side of the plenum and the four ports on the other side of the plenum are closed off. In an I-4 engine, four plenum ports (four on one side) are closed off. An I-8 engine can use a longer plenum configuration with the eight ports all positioned on one side of the plenum.

Figure 5:
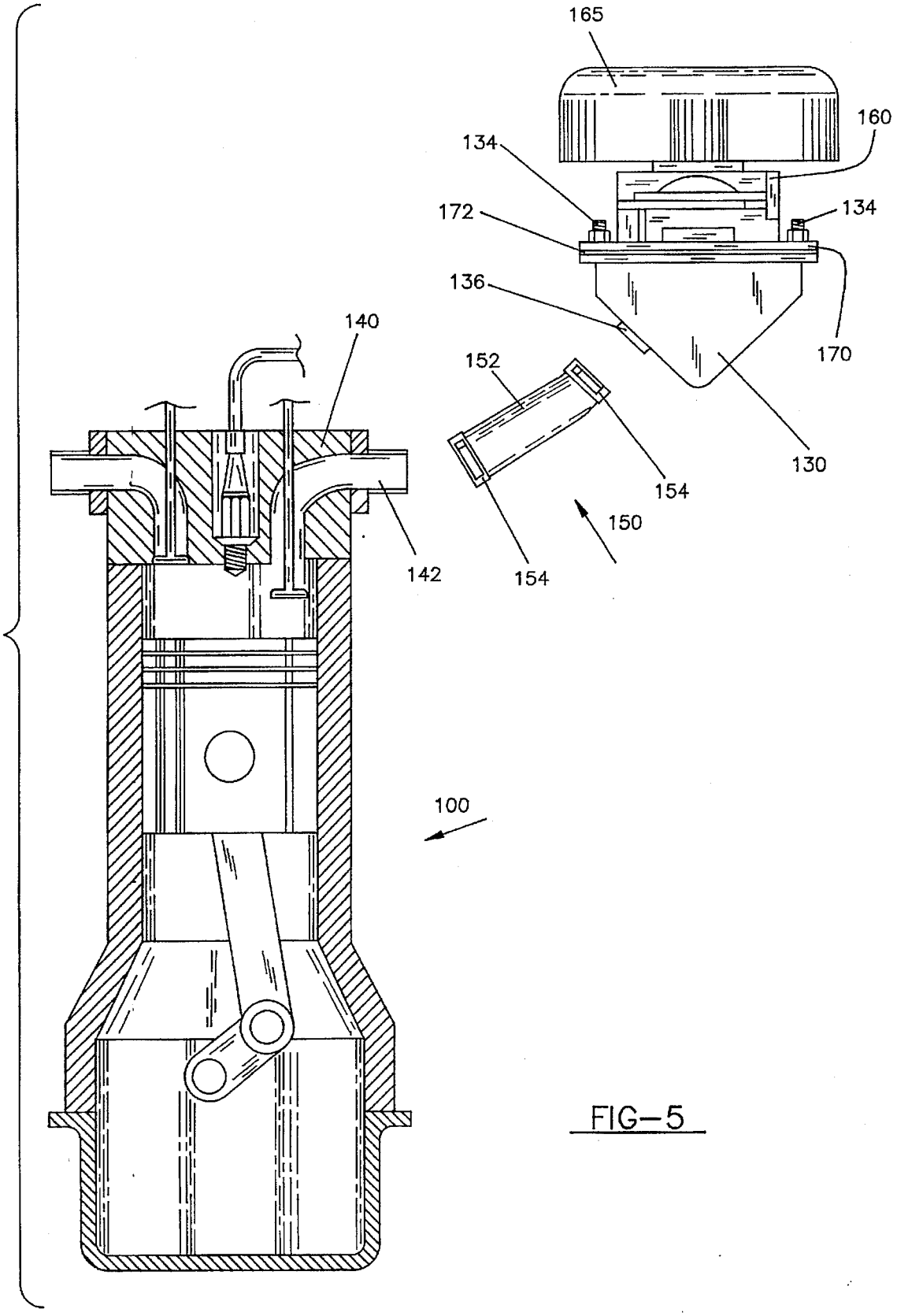
FIG. 5 shows an exploded end view partially in section showing the adjustable induction manifold assembly of the present invention associated with an I-type engine.
Figure 6:
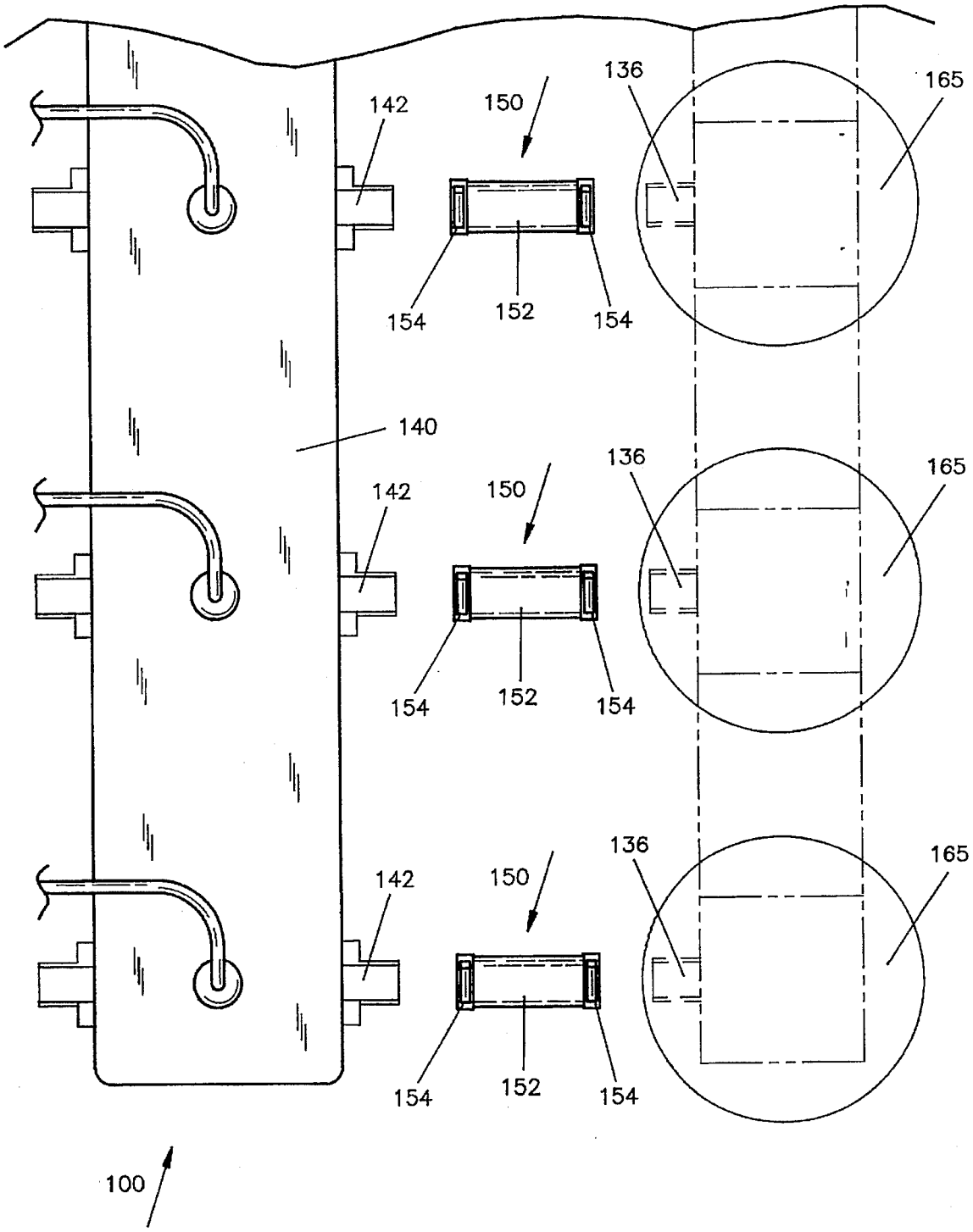
FIG. 6 shows an exploded top cutaway view showing the adjustable induction manifold assembly of the present invention associated with an I-type engine.
Figure 7:
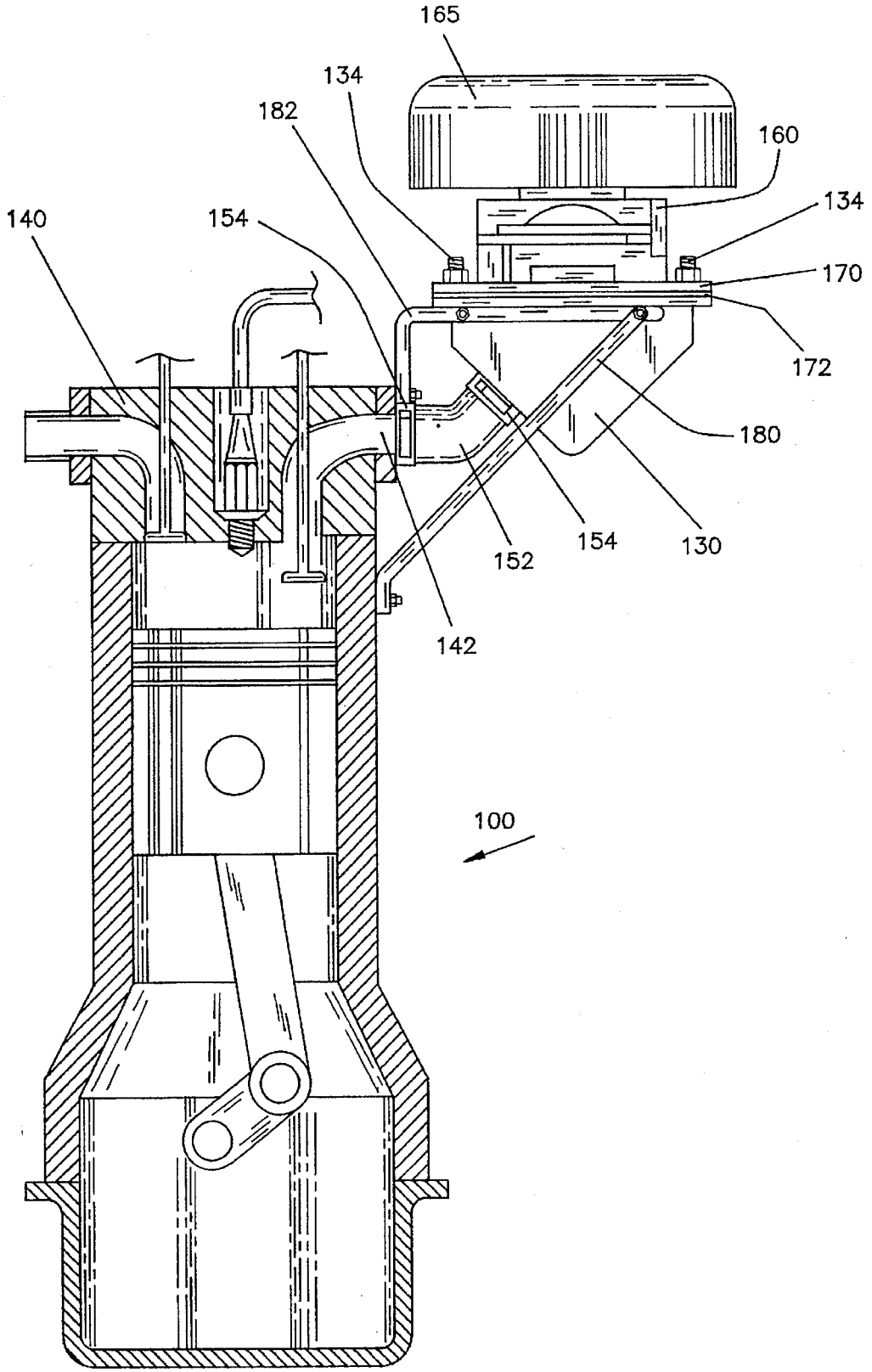
FIG. 7 shows an end view partially in section showing the adjustable induction manifold assembly of the present invention mounted to an I-type engine with brackets.

FIGS. 5, 6 and 7 show the adjustable induction manifold assembly of the present invention configured for an I-type engine. The engine 100 includes a manifold 140 with a plurality of manifold ports 142, one associated with each cylinder. A plenum 130, similar in configuration to the plenum shown in FIGS. 1–4, is generally V-shaped with a hollow interior. The plenum 130 includes a plurality of plenum ports 136 (one for each cylinder on the engine 100) and each plenum port 136 is aligned along one side of the plenum 130 to accommodate the engine being an I-type engine. Each plenum port 136 is connected to its corresponding manifold port 142 on the manifold plate 140 by means of a tube runner assembly 150. The connection of one end of the tube runner 152 to the plenum port 136 is by way of a conventional hose clamp 154 and likewise the other end of the tube runner 152 is also securely connected to the corresponding manifold port 142 on the manifold plate 140 by way of another hose clamp 154. The plenum 130 may also be held in position relative to the engine by any suitable bracket arrangement. With reference to FIG. 7, an upper bracket 182 and a lower bracket 180 are used to hold the plenum 130 in place relative to the engine 100. Alternatively, other bracket arrangements could be used.

On the top of the plenum 130 there is placed a base plate 170 with a gasket 172 set in between for sealing purposes. The base plate 170 closes off the top of the plenum 130 except for the openings which serve as the carburetor intake for any carburetor 160 mounted on the top of the plenum 130. If only one carburetor 160 is being used, then the unneeded carburetor intake openings are closed off by means of a block off plate (not shown) but which is similar to the block plate arrangement described above in connection with FIGS. 1–4. A plurality of bolts 134 are spaced around the perimeter of the top of the plenum 130 and the gasket 172 and base plate 170 are also provided with corresponding apertures around their perimeters to allow the gasket 172 and the base plate 170 to be mounted over the bolts 134 and securely attached to the plenum 130. Each carburetor may be provided with an air cleaner 165 as is conventional.

The manifold plate is built specifically to accommodate the various engine configurations used by the car manufacturers. For example, Chevrolet engines would require the use of one of basically four types of manifold plates, Ford and Chrysler engines have as many or even more than Chevrolet and, of course, the wide variety of engines used in the imported cars would require still other manifold plate designs. The water plates will be basically the same for most engine applications and the thermostat housing can be used without modification on all engine types with brackets being used for specific designs and types.

The adjustable induction manifold assembly of the present invention allows the use of different types of carburetors or fuel injection systems on any one particular engine without having to replace the manifold plate. Any engine can be configured to run using one, two or three carburetors of either the two-barrel type or four-barrel type or fuel injection systems. To change the number or type of carburetors or fuel injection systems being used on any particular engine, it is only necessary to take off or put on the appropriate number of block off plates on the base plate and then attach the carburetor or fuel injection system to the opening in the base plate.

Additionally, and perhaps more importantly, the adjustable induction manifold assembly of the present invention gives the mechanic the ability to raise or lower the power band of the engine at a given RPM by merely raising or lowering the plenum position relative to the manifold plate. This distance is determined by the length of the tube runners and changing out the tube runners is a fairly simple job which can take forty-five minutes or less. The previous alternative to effect a change in the power band of the engine was to replace the camshaft or camshafts, whichever the case may be, which can take seven hours, more or less, to do.

The longer the tube runners are in length, the lower the power band and torque band of the engine becomes. As an example of the change, on a simulated engine, the use of 2" tube runners creates a power band between 3000–6000 RPM. The use of 4" tube runners creates a power band between 2500–5500 RPM. The use of 6" tube runners creates a power band between 2000–5000 RPM.

In summary, the adjustable induction manifold assembly of the present invention provides the mechanic with the ability to use whatever length tube runners are desired to optimize the performance, torque or efficiency of the engine. The location and positioning of the tube runners make changing the length of the tube runners an easy task, without the long times previously involved in changing camshafts. The compact design of the plenum allows quicker response from the engine. The use of a common base plate with none, one or two block off plates allows the use of one, two or three carburetors or fuel injection systems with the changeover between carburetors or fuel injection systems being easy and quick.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. An adjustable induction manifold assembly comprising:

a) a manifold plate sized to fit on the top of a cylinder head of an engine of a V-type design;

b) the manifold plate having a plurality of manifold ports thereon, each manifold port associated with a corresponding cylinder on the engine;

c) a plurality of replaceable tube runners, each tube runner connected to each manifold port;

d) a plenum positioned above the manifold plate and supported by the replaceable tube runners;

e) the plenum having a plurality of plenum ports, each plenum port connected to a corresponding replaceable tube runner so that an air/fuel mixture may pass from the plenum through the replaceable tube runner and into the manifold; and f) a base plate mounted on the top of the plenum, the base plate having at least one opening therein; whereby when a carburetor is mounted in the opening of the base plate, the air/fuel mixture in the carburetor can flow into the plenum and whereby the power band of the engine can be changed by varying the distance between the manifold plate and the plenum by replacing the tube runners with other tube runners of a different length.

2. The assembly of claim 1 in which the manifold plate has a flat central portion and two extending angled flanges one on each side of the central portion and overlying a cylinder head on the engine, each of the two flanges having a plurality of the manifold ports thereon.

3. The assembly of claim 2 in which the plenum has a flat top surface and two extending angled sides, one of the two extending angled sides depending downwardly from each side of the top surface of the plenum, each of the two extending angled sides having a plurality of the plenum ports thereon.

4. The assembly of claim 1 in which the base plate has a plurality of openings therein, each opening being sized to accommodate a carburetor or fuel injection system, and each opening on which a carburetor or fuel injection system is not mounted being closed off by a block off plate.

5. The assembly of claim 1 further including a thermostat housing mounted on the manifold plate and adapted to be connected to a radiator and at least one water plate mounted on the manifold plate and in fluid connection to the thermostat housing whereby water can be provided from the radiator to the engine for cooling purposes.

* * * * *